United States Patent [19]

Rudko

[11] Patent Number: 4,921,196

[45] Date of Patent: May 1, 1990

[54] GARBAGE CONTAINER

[76] Inventor: Ted Rudko, #207, 8604 - 103 Street, Edmonton, Alberta, Canada, T6E 4B6

[21] Appl. No.: 216,807

[22] Filed: Jul. 8, 1988

[30] Foreign Application Priority Data

May 12, 1988 [CA] Canada ..... 566576

[51] Int. Cl.[5] ..... B65B 67/04

[52] U.S. Cl. ..... 248/97; 220/1 T; 220/401; 220/404; 248/99

[58] Field of Search ..... 248/95, 97, 98, 99, 248/100, 101; 220/4 E, 401, 403, 404, 1 T, 423

[56] References Cited

U.S. PATENT DOCUMENTS

| | | | |
|---|---|---|---|
| 2,301,032 | 11/1942 | Fielding | 220/404 X |
| 3,005,571 | 10/1961 | Hall | 220/324 |
| 3,179,287 | 4/1965 | Rickmeier, Jr. | 220/324 X |
| 3,451,582 | 6/1969 | Morgan | 220/401 X |
| 4,069,993 | 1/1978 | Shanks | 248/101 X |
| 4,320,851 | 3/1982 | Montoya | 220/324 |
| 4,416,197 | 11/1983 | Kehl | 220/1 T X |
| 4,445,658 | 5/1984 | Ferron | 248/100 |
| 4,723,743 | 2/1988 | Jenkins | 220/404 X |
| 4,765,579 | 8/1988 | Robbins, III et al. | 220/404 X |

FOREIGN PATENT DOCUMENTS

| | | | |
|---|---|---|---|
| 1182093 | 2/1985 | Canada . | |
| 1218050 | 2/1987 | Canada . | |
| 1221077 | 4/1987 | Canada . | |
| 1226567 | 9/1987 | Canada . | |
| 1116149 | 10/1961 | Fed. Rep. of Germany | 220/403 |
| 2919859 | 11/1980 | Fed. Rep. of Germany | 248/97 |
| 1271791 | 4/1972 | United Kingdom | 220/407 |

*Primary Examiner*—David L. Talbott

*Attorney, Agent, or Firm*—Davis, Bujold & Streck

[57] ABSTRACT

A container having an interior cavity and a peripheral upper edge defining an opening providing access to the cavity. At least one pair of male supports extend substantially vertically from the edge at opposed sides of the opening, to permit a plastic garbage bag to be suspended to hang down through the opening into the cavity. The closure lid for the container has at least one pair of female couplings such that the male supports may be received therein to removably couple the closure with the body.

3 Claims, 5 Drawing Sheets

GARBAGE CONTAINER

The present invention relates to a garbage container.

BACKGROUND OF THE INVENTION

In North America, the bags in which the consumer carries home his groceries from the grocery store are used to collect garbage. For many years those bags were made out of paper. The consumer frequently placed the bags in containers with lids for reasons of sanitation and to prevent unpleasant odours form permeating his home. The paper bags served as disposable liners for such containers. In recent years most major grocery chains have changed from paper bags to bags made out of plastic with integral handles. The consumer has been forced to purchase liners for his existing containers or seek alternate containers to collect his garbage. A variety of alternate containers are now commercially available which are adapted for use with the new bags. The problem with the containers is that they do not have lids as the peripheral edge of such containers have hooks or similar means for supporting the plastic bag by its handles, which prevent conventional lid configurations from being used.

SUMMARY OF THE INVENTION

What is required is a container with a lid which can accommodate the plastic bags presently in use.

In accordance with the present invention there is provided a container which is comprised of a body having an interior cavity and a peripheral upper edge defining an opening providing access to the cavity. At least one pair of male supports is provided which extend substantially vertically from the edge at opposed sides of the opening, to permit a plastic garbage bag to be suspended to hang down through the opening into the cavity. The closure for the container has at least one pair of female couplings such that the male supports may be received therein to removably couple the closure with the body.

Although beneficial results are obtained from use of the container as described above, even more beneficial results may be obtained by modifying the closure to include additional features which permit access to the cavity without removal of the closure. The modified form the closure is comprised of a frame defining a closure opening and a panel having a hinge on one side secured adjacent the opening for pivotal movement between a closed position where the opening is obstructed and an open position where access may be obtained to the cavity through the closure and body openings.

Although beneficial results are obtained from use of the container as described above, even more beneficial results may be obtained by modifying the peripheral edge which defines the opening to permit the container to be used with bags having varying handle positions or bags without handles. The modified form of peripheral edge defines a generally rectangular opening having opposed sides and opposed ends. Two pairs of supports extend substantially vertically from the edge, one of the pairs at opposed sides of the opening and the other of the pairs at opposed ends of the opening, whereby a bag may be suspended from either of the pairs of supports or a bag without handles may have its edge folded over both pairs of supports and secured by the clamping action of the closure.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
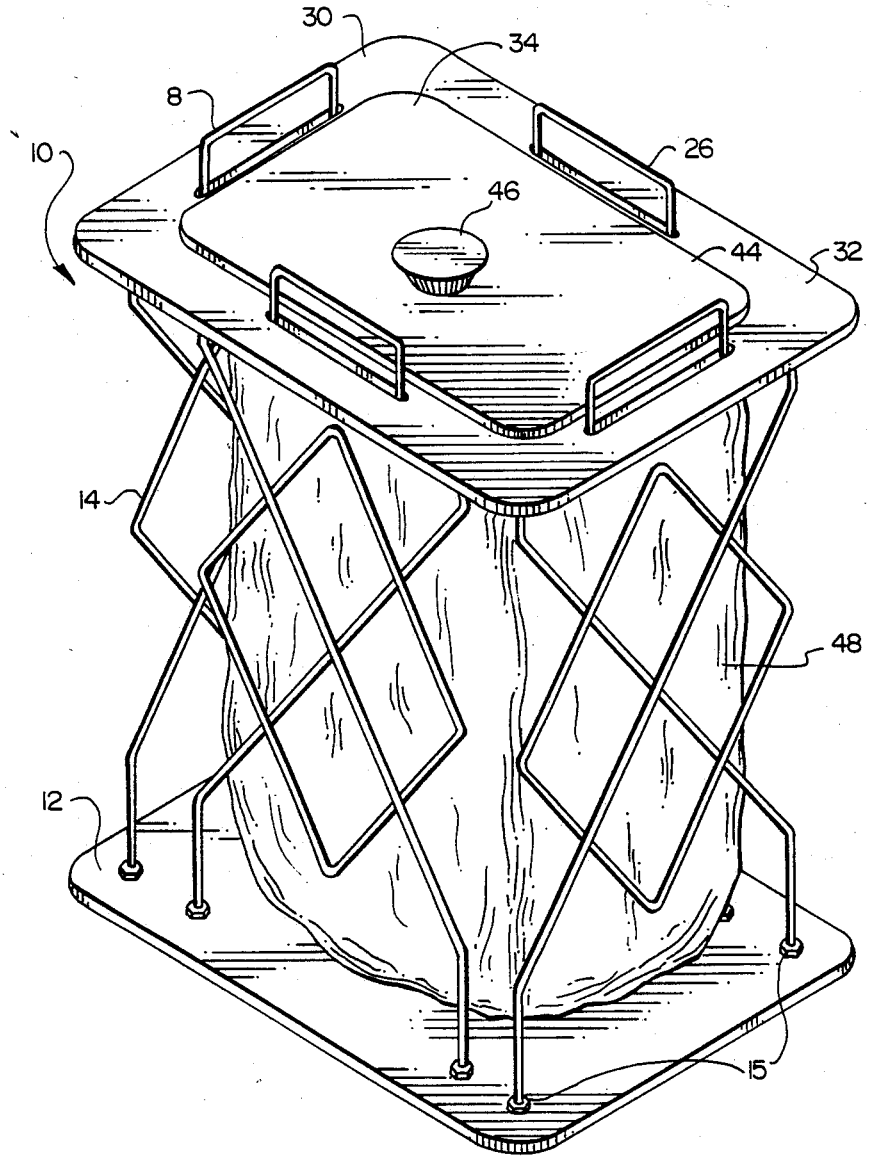
FIG. 1 is a perspective view of a preferred embodiment of the invention.
Figure 2:
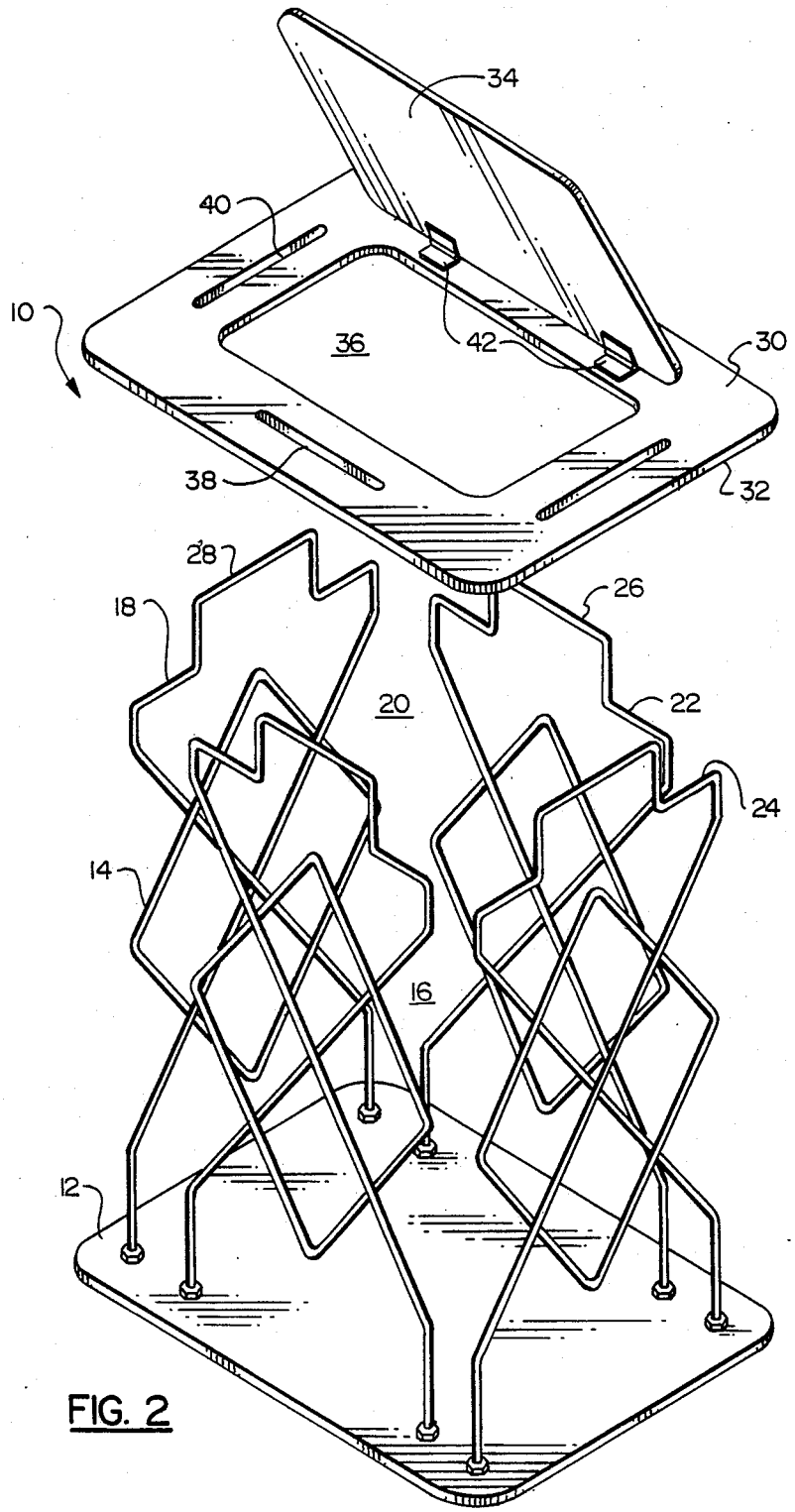
FIG. 2 is an exploded perspective view of the preferred embodiment of FIG. 1.
Figure 3:
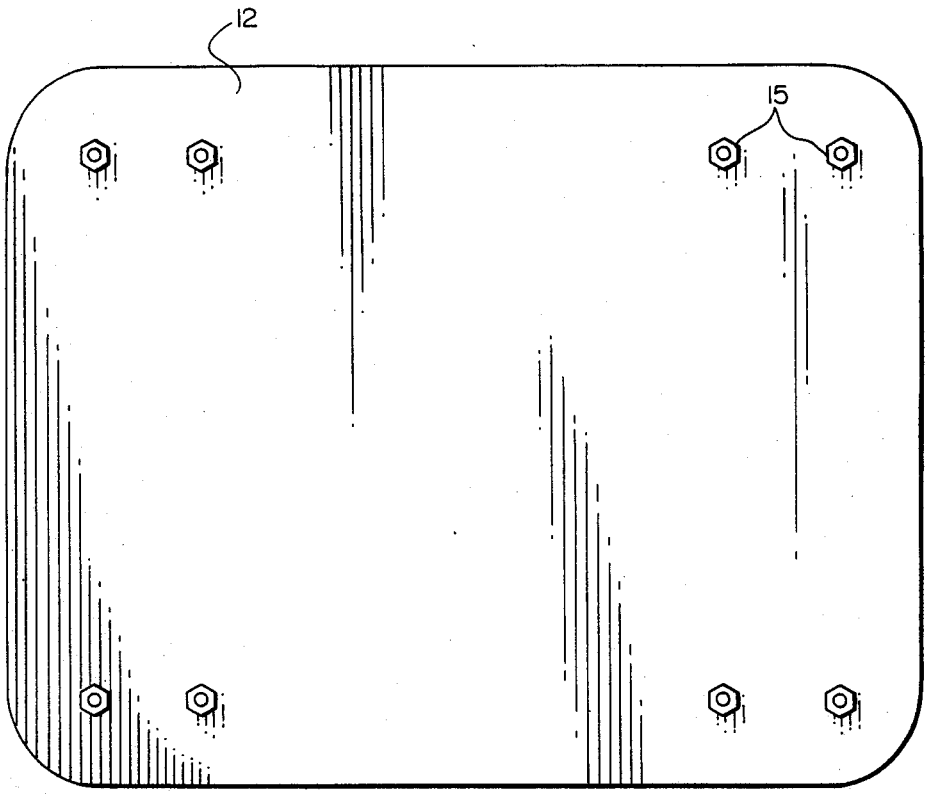
FIG. 3 is a bottom plan view of the preferred embodiment of FIG. 1.

The preferred embodiment will now be described with reference to FIGS. 1 through 5. The preferred embodiment, generally designated by reference numeral 10, is a garbage container. The basic structure of garbage container 10 is best illustrated in FIG. 2.

Garbage container 10 is comprised of a base 12 with a skeletal tubular frame 14 extending vertically therefrom which delineates the boundaries of an interior cavity 16. Tubular frame 14 is secured to base 12 by nuts 15 which are positioned on either side of base 12. Tubular frame 14 has a peripheral upper edge 18 defining a rectangular opening 20 providing access to cavity 16. Edge 18 has opposed sides 22 and opposed ends 24.

Two pairs of shoulders 26 and 28 extend substantially vertically from and are integrally formed on the edge 18. One of the pairs 26 on opposed sides 22 of opening 20 and the other of the pairs 28 on opposed ends 24 of opening 20.

A closure lid 30 is comprised of two primary components a closure frame 32 and a panel 34. Frame 32 defines a closure opening 36 and has two pair of slots 38 and 40. Panel 34 is pivotally mounted to closure 30 by hinges 42 which are mounted along one side 44. A handle 46 is mounted on panel 34.

Figure 4:
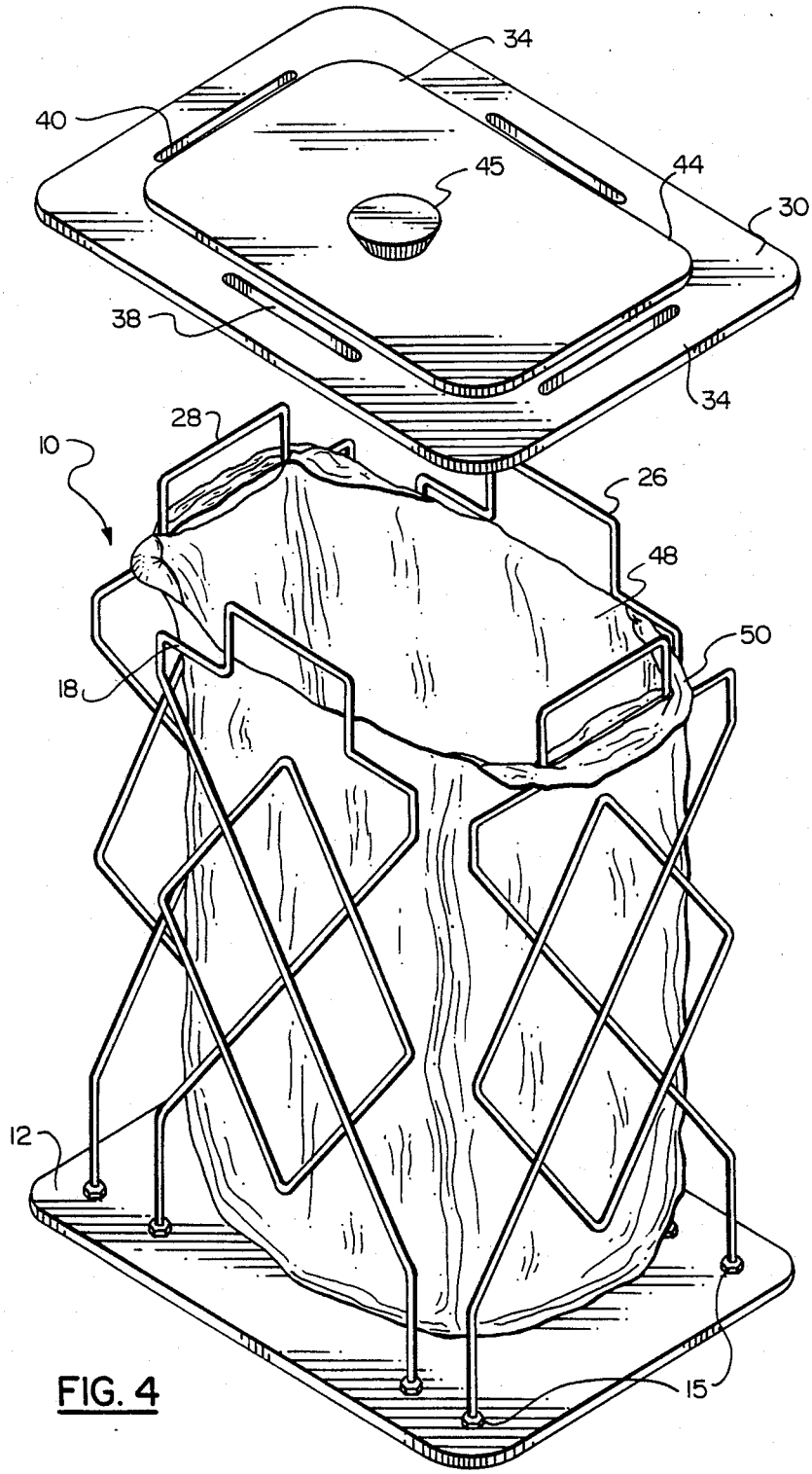
FIG. 4 is an exploded perspective view of the preferred embodiment of FIG. 1 using a bag with handles positioned on the ends.
Figure 5:
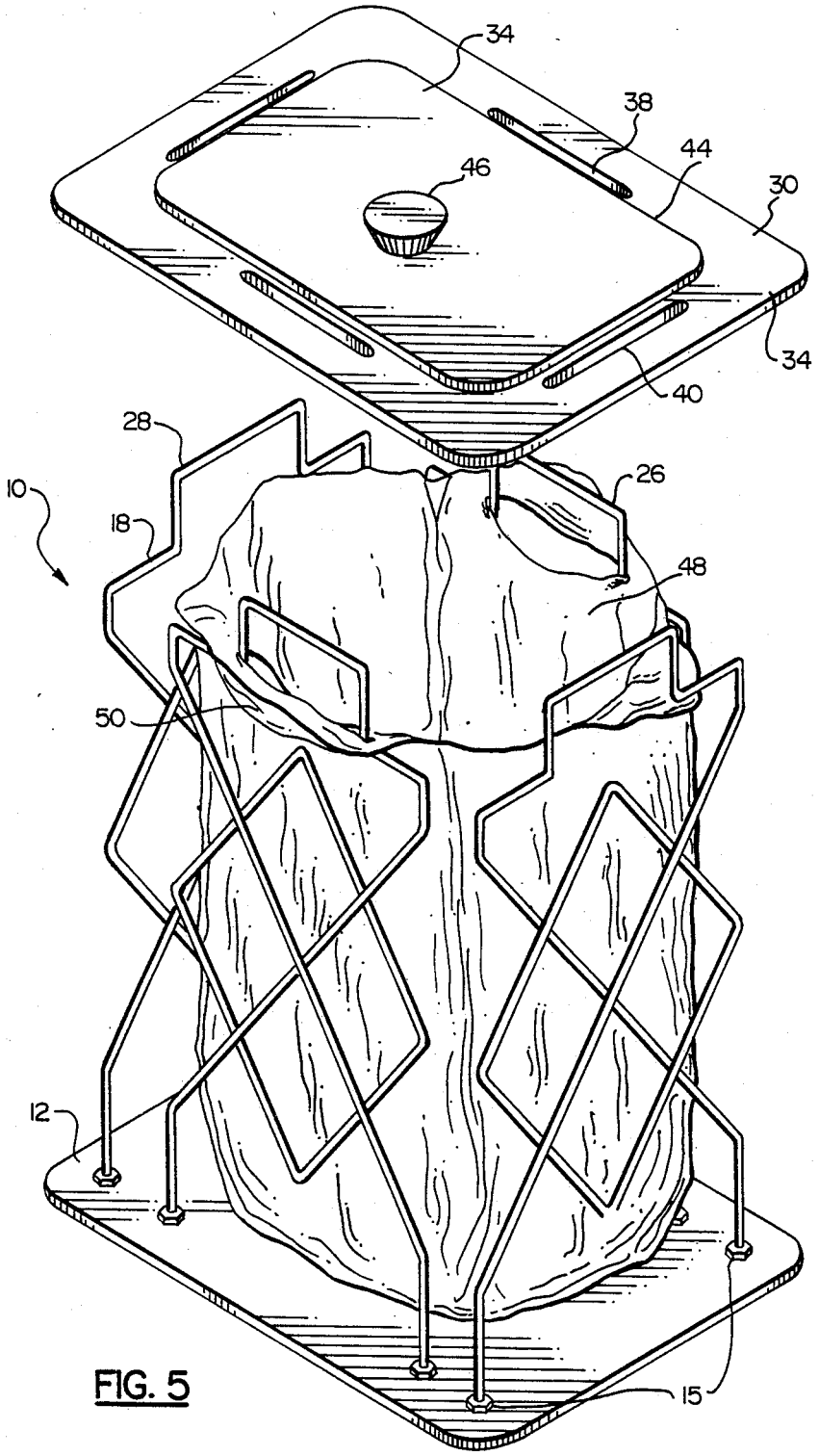
FIG. 5 is an exploded perspective view of the preferred embodiment of FIG. 1 using a bag with handles positioned on the sides.

The use of container 10 will now be described with reference to a plastic bag 48 having handles 50. Container 10 without a bag 48 is illustrated in FIG. 2. With closure lid 30 removed bag 48 is placed within cavity 16. If bag 48 has handles 50 positioned on the side, handles 50 are placed over shoulders 26 as illustrated in FIG. 5. If bag 48 has handles positioned on the end, handles 50 are placed over shoulders 28 as illustrated in FIG. 4. Bag 48 is then suspended from shoulders 26 or 28 across opening 20. Closure lid 30 is then placed on peripheral edge 18 of skeletal tubular frame 18 such that shoulders 26 engage slots 38 and shoulders 28 engage slots 40. In order to place garbage into bag 48, panel 34 is grasped by handle 46 and swung upward on hinges 42. Panel 34 can then be placed back into the closed position obstructing opening 36. Container 10 placed with closure lid 30 in the closed position is illustrated in FIG. 1. When bag 48 becomes full, closure 30 is removed by sliding shoulders 26 and 28 out of slots 38 and 40. Handles 50 of bag 48 are then lifted out of engagement with shoulders 26 and 28 in order that the bag may be removed and replaced.

Although the present invention was designed with grocery bags having handles in mind, it will be apparent to one skilled in the art that plastic liner bags commercially available which do not have handles may be used by placing them over shoulders 26 and 28 and clamping them in position by use of slots 38 and 40. It will further be apparent to one skilled in the art that although the embodiment illustrated has a skeletal frame, the body of the container may be molded out of plastic or otherwise formed. It will finally be apparent to one skilled in the art that in stead of integrally formed shoulders 26 and 28 as illustrated, a variety of configurations can be used for supporting handles 50 of bag 48. For example, pegs could be substituted as bag supports.

The embodiments of the invention in which an exclusive property or privilege is claimed are defined as follows:

1. A container, comprising:

a. a body comprising a base and a skeletal frame extending therefrom defining an interior cavity with a peripheral upper edge defining an opening which provides access to the cavity;

b. at least one pair of shoulders extending substantially vertically from and being integrally formed on the peripheral edge, at opposed sides of the opening, whereby a bag may be suspended to hang down through the opening into the cavity; and c. a closure lid comprising:

i. a frame defining a closure opening and having at least one pair of slots such that the shoulders may be received therein to removably couple the closure lid with the body; and ii. a panel having a hinge on one side secured adjacent the opening for pivotal movement between a closed position in which the opening is obstructed and an open position in which access to the cavity may be obtained through the closure and body openings.

2. A container, comprising:

a. a body having an interior cavity with a peripheral upper edge defining an opening which provides access to the cavity;

b. at least one pair of shoulders extending substantially vertically from and being integrally formed on the peripheral edge at opposed sides of the opening whereby a bag, having handles, may be suspended from said at least one pair of shoulders by its handles to hang down through the opening into the cavity; and c. a closure lid comprising:

i. a frame defining a closure opening and having at least one pair of slots such that the shoulders may be received therein to removably couple the closure lid with the body; and ii. a panel having a hinge on one side secured adjacent the opening for pivotal movement between a closed position in which the opening is obstructed and an open position in which access to the cavity may be obtained through the closure and body openings.

3. A method of suspending a bag with handles in a container, said method comprising the steps of:

a. using a container having a body defining an interior cavity with a peripheral upper edge defining an opening to provide access to the cavity;

b. extending substantially vertically from and being integrally formed with the upper edge at least one pair of shoulders at opposed sides of the opening;

c. placing the handles of the bag over the at least one pair of shoulders and suspending the bag from its handles to hang in the cavity; and d. placing a closure lid, comprising:

i. a frame defining a closure opening and having at least one pair of slots such that the shoulders may be received therein; and ii. a panel having a hinge on one side secured adjacent the opening for pivotal movement between a closed position in which the opening is obstructed and an open position in which access may be obtained to the bag suspended within the cavity through the closure and body openings, over the upper edge of the body so that the at least one pair of slots engage the at least one pair of shoulders and thereby removably couple the closure with the body and securely suspend the bag.

* * * * *